US007601916B2

(12) United States Patent
Caveney et al.

(10) Patent No.: US 7,601,916 B2
(45) Date of Patent: Oct. 13, 2009

(54) CONDUCTOR WITH NON-CIRCULAR CROSS-SECTION

(75) Inventors: Jack E. Caveney, Hinsdale, IL (US); Ronald A. Nordin, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/755,090

(22) Filed: May 30, 2007

(65) Prior Publication Data

US 2007/0277996 A1 Dec. 6, 2007

Related U.S. Application Data

(60) Provisional application No. 60/803,639, filed on Jun. 1, 2006.

(51) Int. Cl.
*H01B 5/08* (2006.01)

(52) U.S. Cl. ..... 174/110 R; 174/113 R; 174/129 R

(58) Field of Classification Search ..... 174/110 R, 174/113 R, 115, 129 R, 133 R
See application file for complete search history.

(56) References Cited

U.S. PATENT DOCUMENTS

| | | | | | |
|---|---|---|---|---|---|
| 5,696,352 | A * | 12/1997 | Kourimsky | ..... | 174/126.3 |
| 5,990,419 | A * | 11/1999 | Bogese, II | ..... | 174/120 R |
| 2004/0168821 | A1 | 9/2004 | Goto | | |
| 2004/0216913 | A1 * | 11/2004 | Wiekhorst et al. | ..... | 174/110 R |
| 2004/0256139 | A1 * | 12/2004 | Clark | ..... | 174/110 R |

FOREIGN PATENT DOCUMENTS

| | | | |
|---|---|---|---|
| JP | 02-223104 | * | 9/1990 |

* cited by examiner

*Primary Examiner*—Chau N Nguyen
(74) *Attorney, Agent, or Firm*—Robert A. McCann; Zachary J. Smolinski; Christopher K. Marlow

(57) ABSTRACT

Communication wires are provided with insulated corrugated conductors. The corrugated conductors have ridges and depressions, such that air gaps are provided between insulation and the outer surfaces of the wires in the regions of the depressions. In some embodiments, the ridges and depressions form a sine wave profile in cross-section. The insulation may be provided with corrugations, and the corrugations of the insulation may align with the corrugations of the conductors. Several wires may be combined into a communication cable.

8 Claims, 6 Drawing Sheets

CONDUCTOR WITH NON-CIRCULAR CROSS-SECTION

CROSS-REFERENCE TO RELATED APPLICATIONS

This application claims priority to U.S. Provisional Application Ser. No. 60/803,639, filed on Jun. 1, 2006, the entirety of which is hereby incorporated by reference.

FIELD OF THE INVENTION

The present invention relates generally to communications cables and more specifically relates to apparatus and methods for reducing the net dielectric constant of the wire insulation.

BACKGROUND OF THE INVENTION

Suppression of alien crosstalk in communication systems is an increasingly important practice for improving systems' reliability and the quality of communication. As the bandwidth of communication systems increases, so does the importance of reducing or eliminating alien crosstalk.

In wired communication systems, crosstalk is caused by electromagnetic interference within a communication cable or between cables. Crosstalk coupling between pairs is proportional to the dielectric constant of the material separating the two pairs. Therefore, decreasing the overall dielectric constant of the material between the conductors decreases the crosstalk between the pairs. There will also be a resulting decrease in alien crosstalk between adjacent communication cables having decreased overall dielectric constants for the materials separating the conductors.

The dielectric constant is a key parameter in the construction of high performance cable. It can be inversely proportional to the signal throughput and directly proportional to the attenuation values when the cable design is properly optimized. Generally, as the dielectric constant decreases, the signal throughput increases and the signal attenuation values decrease—all attributed to the cable dimensional design that can be more favorably optimized. Thus, a lower dielectric constant can result in a stronger signal arriving more quickly with less distortion and less delay skew.

Therefore, there is a need to reduce the overall dielectric constant of the material that separates conductors in a cable in order to reduce crosstalk and delay skew and provide stronger, less attenuated signals.

SUMMARY OF THE INVENTION

According to one embodiment of the present invention, air gaps are provided to decrease the overall dielectric constant of the material between conductors in a corrugated cable.

According to some embodiments of the present invention, a conductor is corrugated to provide air gaps between the conductor and insulation.

According to some embodiments of the present invention, both a conductor and its insulation are corrugated to provide air gaps.

DETAILED DESCRIPTION OF THE ILLUSTRATED EMBODIMENTS

Figure 1:
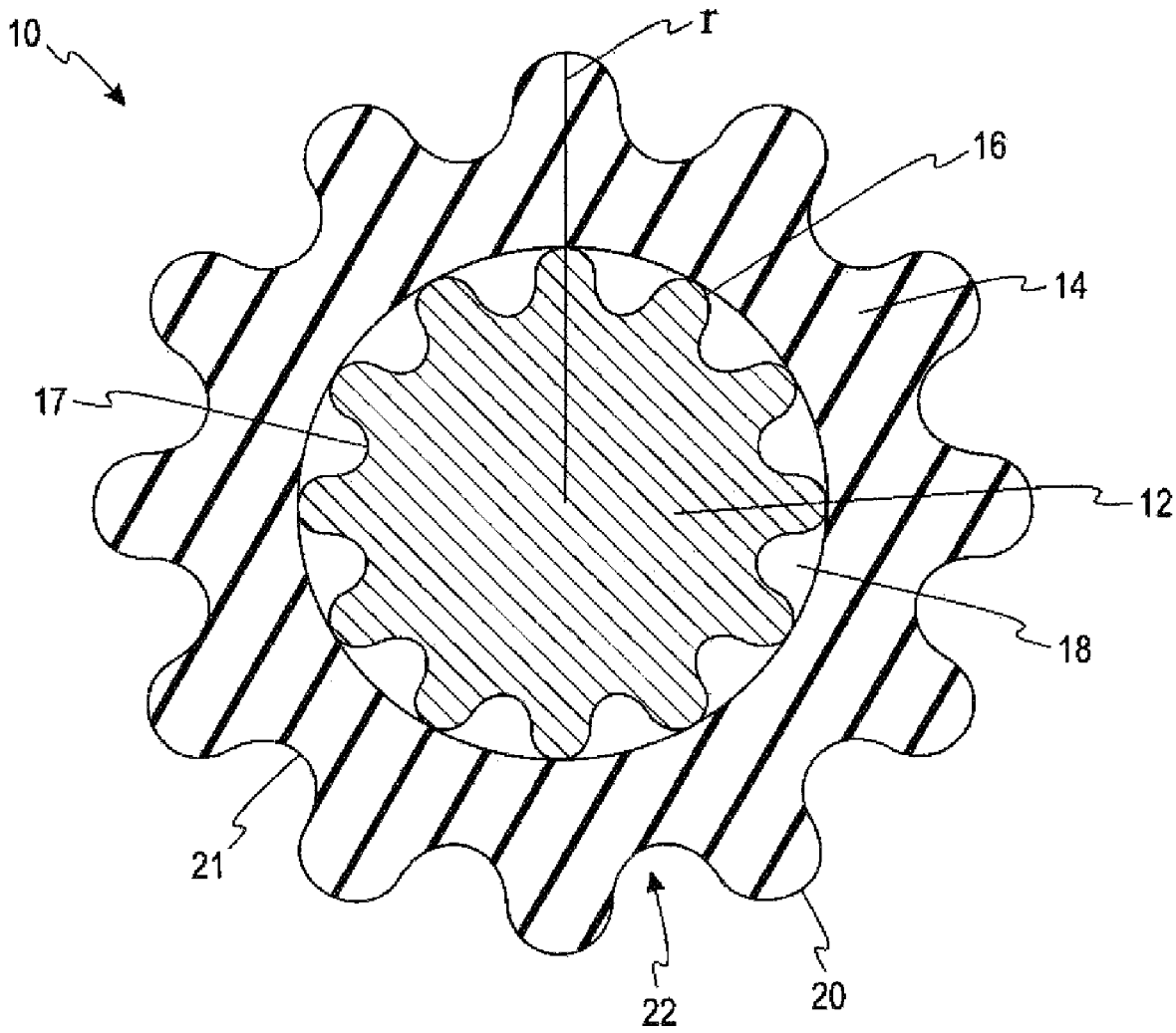
FIG. 1 is a cross-sectional view of a wire according to one embodiment of the present invention.

Turning now to FIG. 1, a cross-sectional view of a wire 10 is illustrated. The wire includes a conductor 12 and an insulator 14. The conductor 12 is non-circular. More specifically, as shown in the embodiment of FIG. 1, the conductor is corrugated, creating ridges 16 and depressions 17 between the conductor 12 and the insulator 14. The ridges 16 and depressions 17 create air gaps 18 that reduce the net dielectric constant of the material between adjacent conductors in a twisted pair. This reduces crosstalk between twisted pairs in a cable comprising multiple twisted pairs.

Corrugating the conductor 12 also increases the surface area of the conductor 12. Conductors are subject to the skin effect, which means that signals travel at or near the outer peripheral surface of the conductor (according to the electromagnetic field pattern). Increasing the surface area of the conductor increases the area that the signals may travel through without increasing the size of the conductor. The conductor 12, with air gaps 18 thus has more capacity to transmit data than a smooth conductor having the same size (for mid range frequencies).

The insulator 14 is also corrugated, having ridges 20 and depressions 21. The ridges 20 and depressions 21 also create air gaps 22. Peaks of the ridges 20 of the insulation 14 are aligned with peaks of the ridges 16 of the conductor 12 so that the insulator 14 does not collapse into the air gaps 18 of the conductor 12 when pressure is applied to the insulator 14. The ridges 20 of the insulator 14 and the ridges 16 of the conductor 12 form a common radius r as shown in FIG. 1.

If pressure is exerted on the insulator 14, there is risk that the insulator 14 may collapse into the air gaps 18 of the conductor 12 under pressure. This would cause the dielectric constant to increase, thereby increasing crosstalk and the likelihood of delay skew. Pressure can occur when two wires 10 are being twisted together to create a twisted wire pair. However, with the design shown in FIG. 1, the alignment of the ridges 16 of the conductor 12 with the ridges 20 of the insulator 14 keeps the insulator 14 from collapsing into the air gaps 18.

Figure 2:
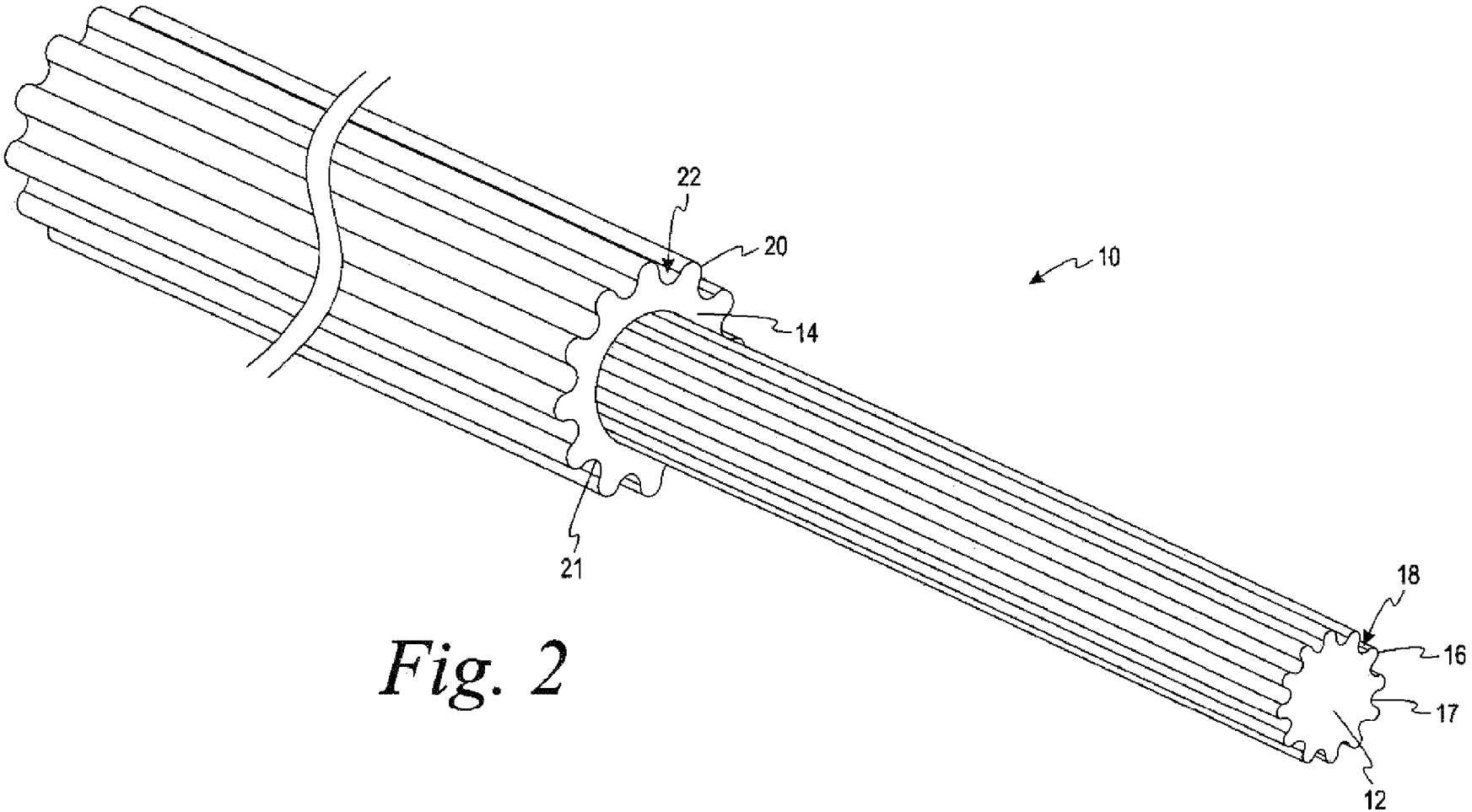
FIG. 2 is a perspective view of the wire of FIG. 1 with a portion of the insulation removed.

FIG. 2 illustrates a perspective view of the wire 10. As seen, the ridges 16 and 20 and depressions 17 and 21 extend the length of the conductor 12 and insulator 14, such that the air gaps 18 and 22 create long channels. As shown in both FIGS. 1 and 2, the ridges 16 and 20 have a sine wave profile. However, other non-circular shapes and curves may also be used. Preferably, the shapes have a rounded edge. Also, there may be any number of ridges and depressions.

Figure 3:
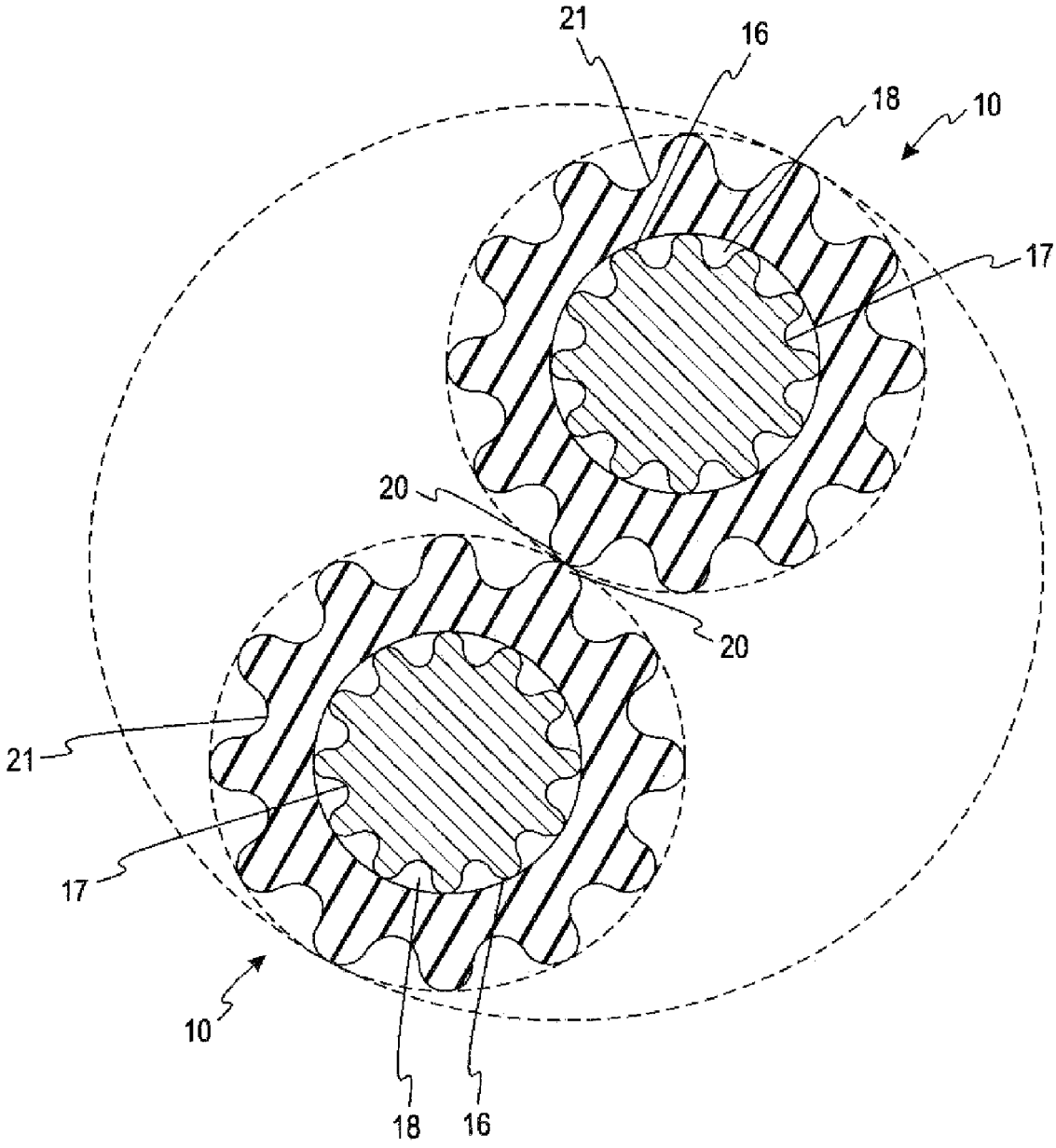
FIG. 3 is a cross-sectional view of a twisted wire pair according to the embodiment of FIG. 1.

FIG. 3 illustrates a cross-sectional view of a twisted wire pair 30 according to the embodiment of FIG. 1. As shown, when the pairs of wires 10 are twisted together, the ridges 20 of the insulators 14 may press against each other. However, because peaks of the ridges 16 of the conductors 12 are aligned with peaks of the ridges 20 of the insulators 14, neither of the insulators 14 collapse into the air gaps 18 of the conductors 12. Thus, the overall dielectric constant of the material between the conductors 12 remains low.

Figure 4:
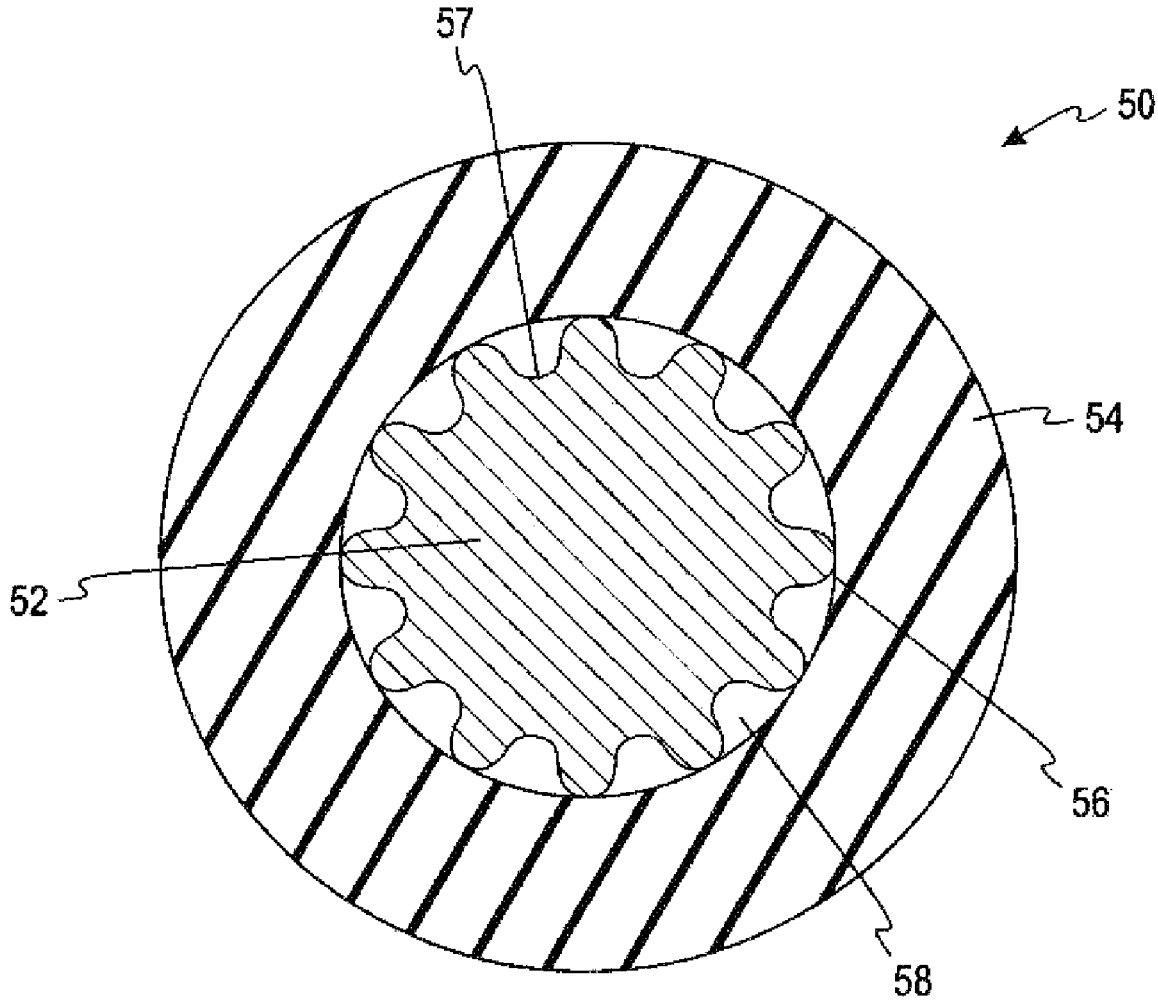
FIG. 4 is a cross-sectional view of a wire according to another embodiment of the present invention.

Turning now to FIG. 4, another embodiment of the present invention will be described. A wire 50 is illustrated having a non-circular conductor 52 and an insulator 54. The conductor 52 includes ridges 56 and depressions 57, which creates air gaps 58. The insulator 54 is a smooth circular surface, with no ridges or depressions. The air gaps 58 reduce the overall dielectric constant of the material between the conductors 52.

Figure 5:
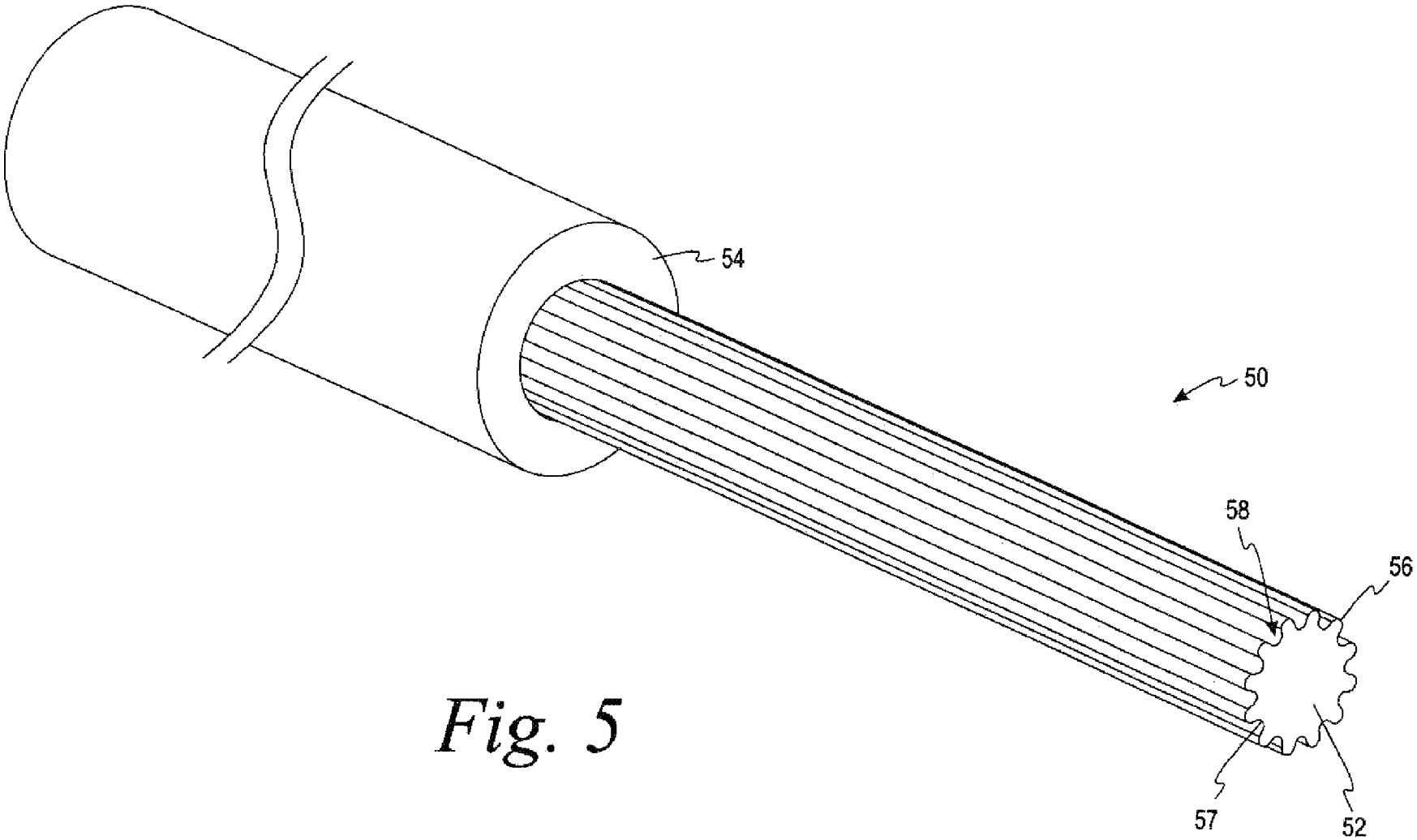
FIG. 5 is a perspective view of the wire of FIG. 4 with a portion of the insulation removed.

FIG. 5 illustrates a perspective view of the embodiment of FIG. 4. As shown, the ridges 56 and depressions 57 extend along the length of the conductor, such that the air gaps 58 create channels. The ridges 56 and depressions 57 create a sine wave profile, but other shapes and/or curves may be used. Preferably, the shapes have a rounded edge. Also, there may be any number of ridges 56 and depressions 57.

Figure 6:
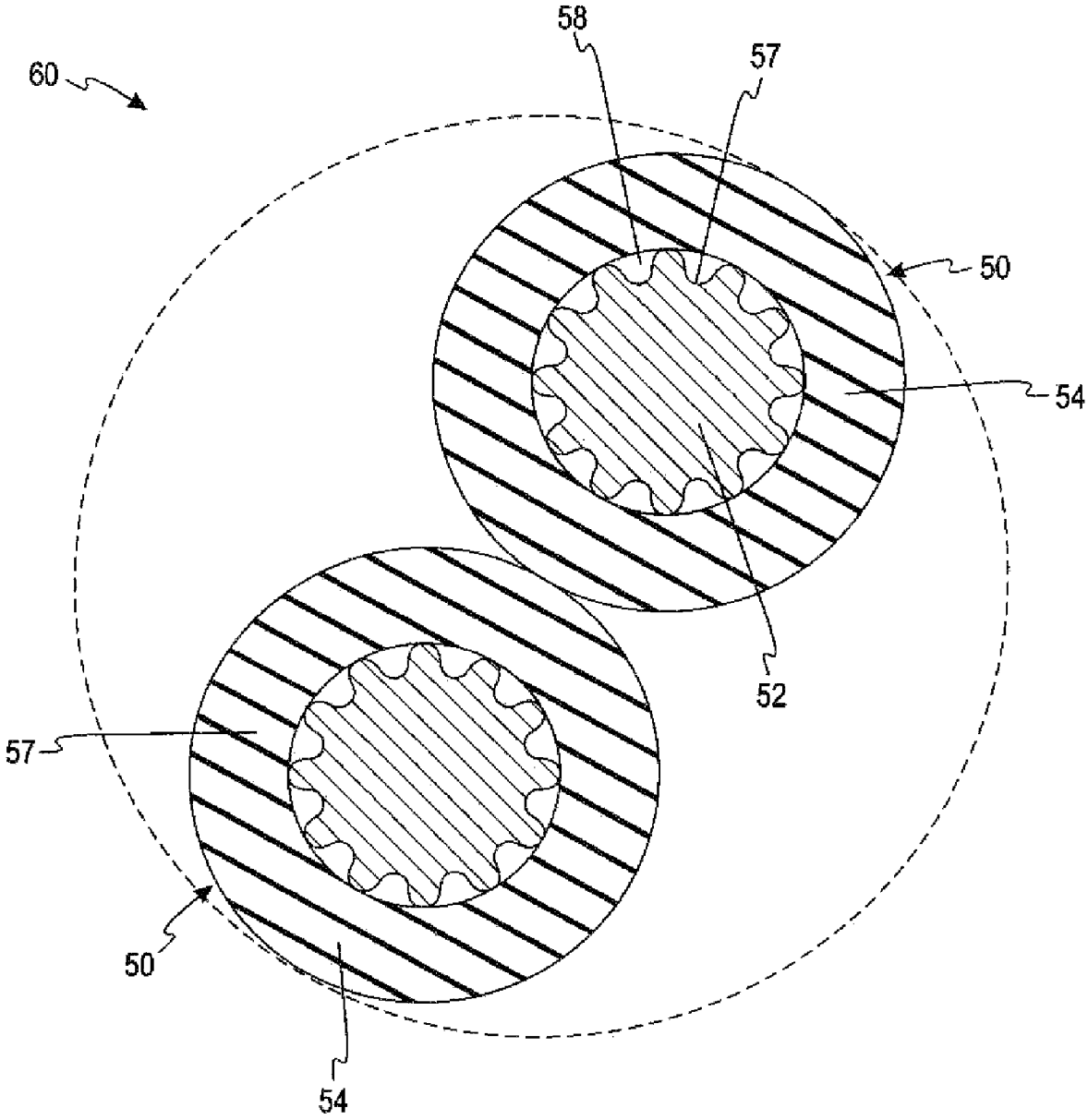
FIG. 6 is a cross-sectional view of a twisted wire pair according to the embodiment of FIG. 4.

FIG. 6 illustrates a cross-sectional view of a twisted wire pair 60 according to the embodiment of FIG. 3. As shown, the pair of wires 50 are twisted together such that the insulators 54 abut. The conductors 52 are corrugated such that the air gaps 58 remain.

While particular embodiments and applications of the present invention have been illustrated and described, it is to be understood that the invention is not limited to the precise construction and compositions disclosed herein and that various modifications, changes, and variations may be apparent from the foregoing descriptions without departing form the spirit and scope of the invention.

When the dielectric constant is reduced as suggested in this application, the design of the wire pair can be optimized for performance. As the dielectric constant decreases, the capacitance per unit length will decrease proportionally. In order to keep the characteristic impedance constant (i.e., $Z_0$=SQRT (L/C)), the wire diameters can be increased thus increasing the capacitance per unit length. This increase in the wire diameter will lower the attenuation of the wire pair due to the increase in outer surface area of the wires. On the other hand, if the capacitance is kept smaller due to the decreased dielectric constant, in order to achieve constant characteristic impedance, the inductance must be decreased. With this smaller capacitance and inductance, the characteristic impedance remains constant and the propagation velocity will increase (velocity=1/(SQRT(LC))).

The invention claimed is:

1. A wire for conducting communication signals, said wire comprising:

a corrugated conductor with an outer surface having ridges and depressions thereon, said ridges and depressions having a sine wave profile in cross-section;

an insulator surrounding said corrugated conductor wherein said insulator is a corrugated insulator with an outer surface comprising insulator ridges and depressions thereon and said insulator ridges are aligned with said ridges of said corrugated conductor; and air gaps between the outer surface of the corrugated conductor and an inner surface of said insulator in regions of said depressions of said conductor.

2. A cable for conducting communication signals, said cable being formed of a plurality of wires, at least one of said plurality of wires comprising:

a corrugated conductor with an outer surface having ridges and depressions thereon, said ridges and depressions having a sine wave profile in cross-section;

an insulator surrounding said corrugated conductor wherein said insulator is a corrugated insulator with an outer surface comprising insulator ridges and depressions thereon and said insulator ridges are aligned with said ridges of said corrugated conductor; and air gaps between the outer surface of the corrugated conductor and an inner surface of said insulator in regions of said depressions of said conductor.

3. The cable of claim 2 wherein all of said plurality of wires have said corrugated conductors, said insulators surrounding said corrugated conductors, and said air gaps.

4. The cable of claim 2 wherein said plurality of wires are arranged as twisted wire pairs.

5. A wire for conducting communication signals, said wire comprising:

a corrugated conductor with an outer surface having conductor ridges and depressions thereon, each of said conductor ridges having a peak; and a corrugated insulator surrounding said corrugated conductor, said corrugated insulator having an outer surface with insulator ridges and depressions thereon, each of said insulator ridges having a peak; wherein said peaks of said conductor ridges are aligned with said peaks of said insulator ridges.

6. The wire of claim 5 wherein said conductor ridges and depressions have a sine wave profile in cross-section.

7. The wire of claim 5 wherein said insulator ridges and depressions have a sine wave profile in cross-section.

8. The wire of claim 5 wherein said conductor ridges have rounded edges.

* * * * *